United States Patent [19]

Zukausky

[11] 4,451,809

[45] May 29, 1984

[54] ELECTROMAGNETIC DEVICE

[75] Inventor: Keith E. Zukausky, Hanover, Ill.

[73] Assignee: Eaton Corporation, Cleveland, Ohio

[21] Appl. No.: 355,833

[22] Filed: Mar. 8, 1982

[51] Int. Cl.[3] ..... H01F 7/08

[52] U.S. Cl. ..... 335/255; 335/247; 335/262

[58] Field of Search ..... 335/279, 258, 262, 263, 335/247, 249, 281, 255

[56] References Cited

U.S. PATENT DOCUMENTS

| | | | |
|---|---|---|---|
| 1,226,748 | 5/1917 | Burnham | 335/247 |
| 1,385,181 | 7/1921 | Lorenz | 335/255 |
| 1,650,799 | 11/1927 | Lee | 335/262 |
| 3,348,147 | 10/1967 | Erickson et al. | 335/262 |

*Primary Examiner*—Harold Broome

*Attorney, Agent, or Firm*—C. H. Grace; R. A. Johnston

[57] ABSTRACT

A solenoid for use with an alternating current power supply has a stationary pole piece and a movable armature provided with an axially extending food means comprising in one embodiment a ring of nonmagnetic material and in another embodiment a plurality of ferromagnetic lugs on the end adjacent the pole piece. The lugs are disposed in peripherally spaced arrangement and extend axially from the armature in the region of contact with the pole piece to prevent rocking and orbiting buzz. The armature optionally includes a shading ring and/or slot extending a portion of the length thereof.

12 Claims, 7 Drawing Figures

Fig. 4
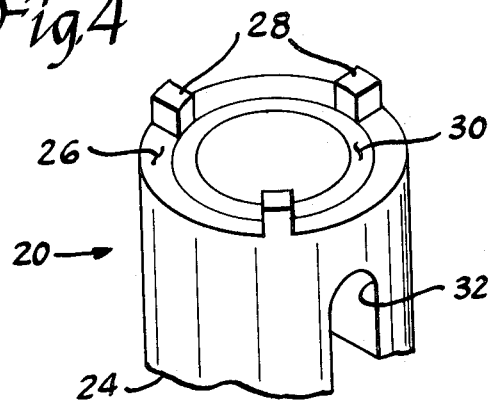
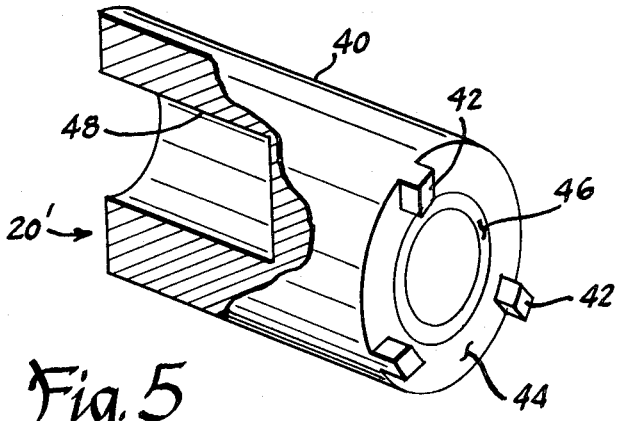
Fig. 5

ELECTROMAGNETIC DEVICE

BACKGROUND OF THE INVENTION

The present invention relates to electromagnetic devices actuated from a source of alternating current power. In particular, the invention relates to solenoids having a coil, a pole piece and an armature which move relative to each other upon energization of the coil to cause contact between the armature and stationary pole piece. Such devices are employed in controls for domestic appliances as, for example, the operation of pilot actuated water inlet valves for household washing machines and dishwashers.

In the design of solenoids for alternating current service, it is known to employ a shading ring or highly electrically conductive material embedded in a ring configuration in the end of the armature to provide a phase shifted current when the armature and pole piece air gap is reduced to zero. When the armature is in contact with the pole piece, magnetomotive force goes to zero periodically without a shading ring and to a reduced level with a shading ring due to the alternating nature of the electrical current in the coil, thereby producing chatter or buzz of the armature while in contact with the pole piece.

In addition, the chatter or buzz of the armature when in contact with the pole piece, causes the armature to rock or orbit within the armature guide. If the guide is fitted to the armature with very low clearance in order to prevent such rocking, the guide tends to create drag on the armature during its axial movement and prevents operation.

It has thus been desired to find a way or means of eliminating chatter or buzz of an armature in an electromagnetic device in alternating current service and without the need to decrease the clearance between the armature and the armature guide.

SUMMARY OF THE INVENTION

The present invention provides a solution to the above-described problem of reducing the chatter or buzz of an alternating current actuated electromagnetic device. The present invention provides a solenoid having a ferromagnetic pole piece and especially configured ferromagnetic armature which moves to contact the pole piece upon alternating current flowing through the coil.

The armature has foot means comprising in one embodiment a plurality of ferromagnetic projections or lugs extending axially from the end thereof and spaced about the periphery and in another embodiment a nonmagnetic ring. The lugs are sufficiently small in area, with respect any unshaded portion the transverse section of the armature, so as to become magnetically saturated upon the normal working current flowing through the solenoid coil. Movement of the armature toward the pole piece under the magnetic forces generated by current flow in the coil, causes the pole piece to only contact the foot means on the axial end thereof. This arrangement provides stability to the contact of the armature with the pole piece and thereby serves to eliminate or significantly reduce chatter and buzz. In another embodiment, a nonmagnetic ring about the periphery of the armature end provides a stable contact surface between the armature and pole piece which reduced rocking or orbiting of the armature. An optional shading ring is provided on the end of the armature to further reduce the effects of variation in forces produced by the alternating current.

BRIEF DESCRIPTION OF THE DRAWINGS

FIG. 4 is a somewhat perspective view of the lugged portion of armature for the device of FIG. 1;

FIG. 5 is a view similar to FIG. 4 of an alternate embodiment of the armature;

DETAILED DESCRIPTION

Figure 1:
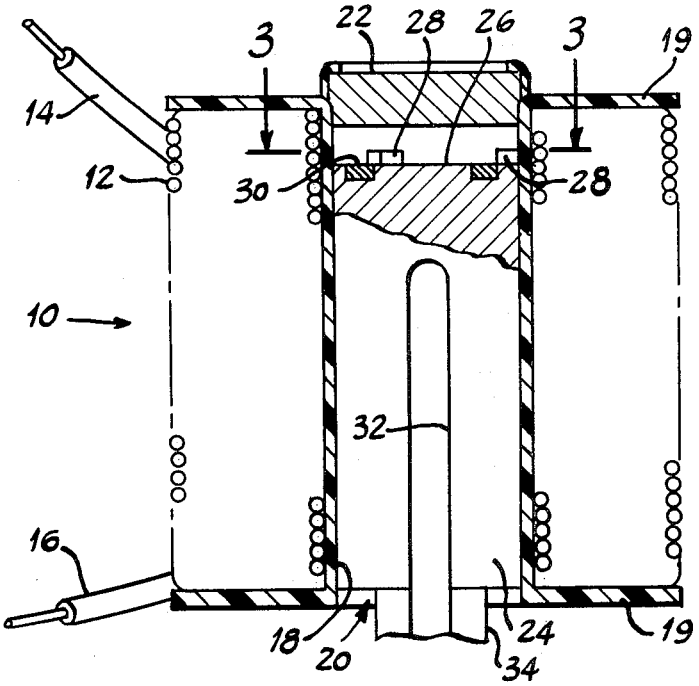
FIG. 1 is a schematic view of the electromagnetic device of the present invention with portions broken away to shown the pole piece and armature.
Figure 2:
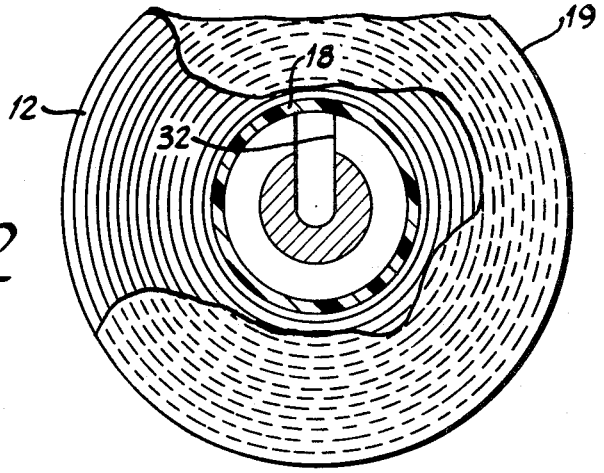
FIG. 2 is an end view of the assembly of FIG. 1 with portions of the bobbin flange broken away.

Referring now to FIG. 1, the electromagnetic device of the present device is indicated generally at 10 and has the coiled conductor 12 wound in a plurality of turns terminating in connection leads 14, 16. The coil 12 has a preferably plastic bobbin or core 18 having a tubular configuration with flanges 19 and has received therein a movable armature, indicated generally at 20, and a pole piece 22 provided at one end thereof in stationary attachment. In the embodiment illustrated in FIG. 1 the pole piece is retained by crimping the end of the core tube 18 and the pole piece has a shoulder registering against a corresponding ledge formed in the inner periphery of the core 18. However, any suitable means for retaining the pole piece in the core 18.

Figure 3:
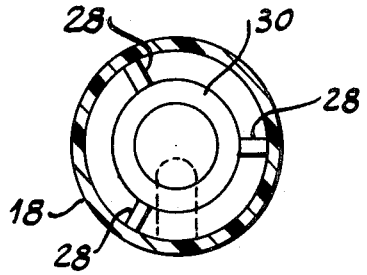
FIG. 3 is a section view taken along section indicating lines 3—3 of FIG. 1.

Armature 18 has a generally cylindrical body portion 24 received in suitably loose fitting sliding engagement with the inner periphery of core 18. The armature body 24 has foot means thereon comprising a plurality of lugs 28 extending axially from the end of the body 26 adjacent the pole piece 22. With reference to FIG. 3, the lugs 28 are shown as comprised of preferably three lugs disposed in circumferentially equally spaced arrangement.

An optional shading ring 30 is provided in a groove formed in the end face 26 of the armature body 24; and, shading ring 30. The shading ring is formed of a suitable electrically conductive material such as, for example, aluminum or copper. The shading ring functions in a manner known in the art to minimize the variations in the magnetomotive force due to the alternating current.

The area of the lugs in a direction transverse to the longitudinal dimension of the armature is chosen small with respect to the total transverse section area of armature body 24 in order that flux saturation occur at the desired coil operating current. Saturation of the lugs 28 preserves the relationship between shaded and unshaded reluctance as the current alternates when the lugs are in contact with the pole piece 22. This produces smoothing of the magnetomotive force; and, thus aids in preventing chatter or buzz with the armature in contact with the pole piece.

Armature body 24, in the presently preferred practice of the invention, employs a radial groove 32 extending longitudinally from the lower end of the armature along the outer periphery thereof terminating adjacent the upper end face 26 of the armature. The groove 32 extends radially to a depth at least to the center of armature body 24.

In the presently preferred practice of the invention, the groove has a width less than one-fourth the transverse width or diameter of the armature. The armature has a portion 34 extending outwardly of the bobbin flange 19 and is adapted for mechanical attachment thereto for operating an associated mechanism.

Referring now to FIG. 5, an alternate embodiment of the armature is shown as having a generally cylindrical body 40 with foot means thereon comprising a plurality of lugs 42 extending from the end face 44 thereof similar to lugs 28 of the embodiment of FIG. 4. A shading ring 46 is embedded in a groove formed in the face 44 similar to that shown in the embodiment of FIG. 4. Armature body 40 has a hollow or bore 48 formed therein from the end remote from the pole piece 22 and bore 48 serves to lighten the armature.

Figure 6:
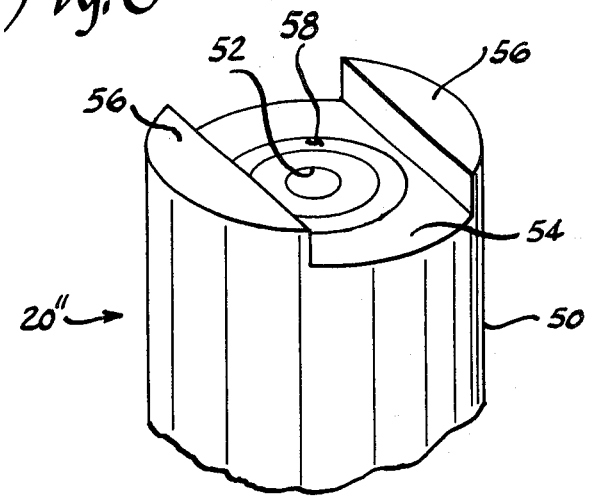
FIG. 6 is a view similar to FIG. 4 of a further alternate embodiment of the armature of the device of FIG. 1.

Referring now to FIG. 6, a further alternate embodiment of the armature indicated generally at 20'' is shown wherein the armature body 50 has a generally cylindrical configuration with a central bore 52 extending longitudinally therethrough. The armature end face 54 is disposed adjacent pole piece 22 and has extending axially therefrom foot means comprising a pair of diamatrially spaced lugs 56 which extend axially from the circular end face of the body 50 forming chordal segments thereof.

The lugs 56 thus provide registration surfaces for contact of the armature with pole piece 22 in such a manner as to minimize rocking. The surface area of lugs 56 is likewise chosen in order that the operating current of the coil will cause the lugs 56 to be magnetically saturated and assist in attenuating the variation of magnetomotive force thereby reducing buzz and chatter.

End face 54 of body 50 has a shading ring 58 embedded in a groove provided therein similar to the ring of the armature of FIG. 4.

Figure 7:
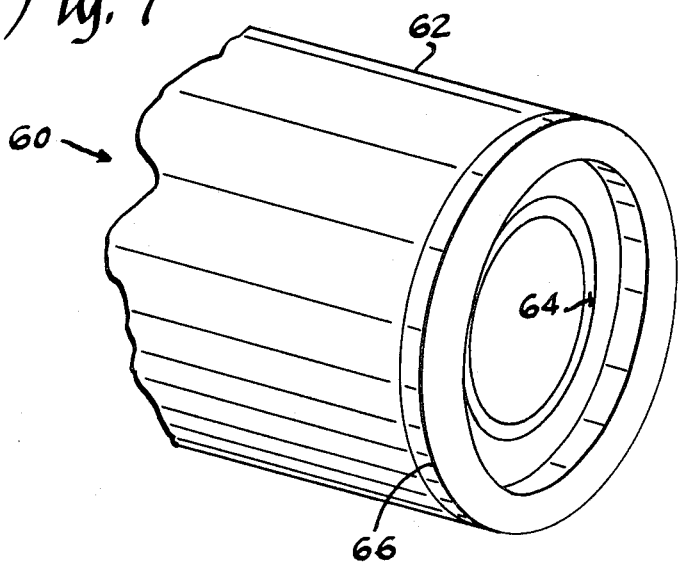
FIG. 7 is a perspective view of a portion of another alternate embodiment of the armature of FIG. 1.

Referring now to FIG. 7, another embodiment of the armature is indicated generally at 60 as having a generally cylindrical body 62 of ferromagnetic material. The axial end face of body 62 preferably has a shading ring 64 of suitable electrically conductive material such as aluminum or copper received therein similar to ring 30, 46 or 58 of the FIGS. 4, 5 and 6 embodiments.

Foot means comprising an annular member 66 is received on the axial end of armature 60 adjacent pole piece 22. The annular member 66 is formed of suitable nonmagnetic material, as for example, plastic or brass and serves the same function as lugs 28, 42 or 56.

The present invention thus provides a novel construction for an electromagnetic device having a coil, stationary pole piece and movable armature. The armature of the present invention has foot means extending axially therefrom in the form a plurality of axial lugs extending from the end face thereof or a nonmagnetic ring provided on the end face. Contact with the pole piece is made by only the foot means thereby providing stability against rocking and orbiting thereby aiding in the reduction of chatter and buzz.

Although the invention has hereinabove been described in the present preferred practice, it will be apparent to those skilled in the art that modifications and variations of the invention may be made; and, the invention is limited only by the following claims.

I claim:

1. An electromagnetic actuator comprising:

(a) coil means defining one or more turns of conductor material having a relatively high electrical conductivity;

(b) pole piece means including a member formed of material of relatively high magnetic permeability and disposed centrally with respect to said coil turn;

(c) armature means disposed centrally with respect to said coil turn, said armature means including a member formed of material of high magnetic permeability disposed in axially spaced arrangement with respect to said pole piece means, and armature member having provided thereon a plurality of peripherally spaced lugs extending axially therefrom about the periphery thereof, with the area of the lugs in a direction transverse to the longitudinal dimension of the armature being small with respect to the transverse section area of the armature such that, upon a desired current flowing through said coil means, said lugs become magnetically saturated and, (d) upon flowing an alternating electrical current through said coil means, a force is applied to said armature means causing said armature member to move toward said pole piece means until further movement thereof is arrested by said lugs contacting said pole piece means thereby preventing rocketing or orbiting.

2. The actuator assembly defined in claim 1 wherein said armature member has an annular shading member formed of material of relatively high electrical conductivity disposed on the end thereof for providing, upon an alternating current flowing in said coil, induced current therein having a phase shifted from said coil current such that the force experienced by said armature is the instantaneous sum of the forces due to the coil current plus the current in the shading member.

3. The actuator assembly defined in claim 1, wherein said armature member includes three of said lugs disposed about the periphery of said armature in peripherally equally spaced arrangement.

4. The actuator assembly defined in claim 1, wherein said armature member has a highly conductive shading ring recessed in the lugged end thereof such that said lugs extend axially beyond the surface of said shading ring.

5. The actuator assembly defined in claim 1, wherein said armature member has a generally cylindrical configuration with a radial recess formed therein extending a substantial portion of the axial length of said member.

6. The assembly defined in claim 1, wherein said pole piece member, said armature member and said lugs are formed of ferromagnetic material said armature member and said lugs being formed integrally.

7. The actuator assembly defined in claim 1, further comprising means for biasing said armature away from said pole piece means.

8. A solenoid assembly comprising:

(a) a coil of electrically conducting material having a plurality of turns;

(b) an armature slidably received in said coil and having a generally cylindrical configuration with a plurality of lugs extending axially from one end thereof about the periphery thereof, with the area of the lugs in a direction transverse to the longitudinal dimension of the armature being small with respect to the transverse section of the armature such that, upon a desired alternating current flowing through said coil means, said lugs become magnetically saturated, and an axially extending slot formed in the surface of said armature; and, (c) pole piece means disposed adjacent the lugged end of said armature.

9. The assembly defined in claim 8, wherein said slot extends radially inward to the center of said armature.

10. The assembly defined in claim 8, wherein said slot extends axially through the end of said armature remote from said lugs.

11. The assembly defined in claim 8, wherein said slot has a transverse width not greater than one-fourth of the transverse width of said armature.

12. The assembly defined in claim 8, wherein said slot has a radial depth not less than one-half the smallest transverse width of said armature member.

* * * * *